United States Patent [19]

Hamisch, Jr.

[11] 4,327,640

[45] May 4, 1982

[54] SELECTIVE PRINTING APPARATUS

[75] Inventor: Paul H. Hamisch, Jr., Franklin, Ohio

[73] Assignee: Monarch Marking Systems, Inc., Dayton, Ohio

[21] Appl. No.: 224,779

[22] Filed: Jan. 13, 1981

Related U.S. Application Data

[62] Division of Ser. No. 95,854, Nov. 19, 1979.

[51] Int. Cl.[3] ..... B41J 1/60

[52] U.S. Cl. ..... 101/110

[58] Field of Search ..... 101/109, 110, 111, 288, 101/105-108, 45, 92, 290, 291

[56] References Cited

U.S. PATENT DOCUMENTS

| | | | |
|---|---|---|---|
| 3,972,281 | 8/1976 | Sams | 101/110 |
| 4,013,005 | 3/1977 | Keefe | 101/110 |
| 4,018,157 | 4/1977 | Sato | 101/110 |
| 4,096,800 | 6/1978 | Kistner et al. | 101/110 |
| 4,149,460 | 4/1979 | Sato | 101/110 |

FOREIGN PATENT DOCUMENTS

| | | | |
|---|---|---|---|
| 2350537 | 4/1975 | Fed. Rep. of Germany | 101/110 |

*Primary Examiner*—E. H. Eickholt

*Attorney, Agent, or Firm*—Joseph J. Grass

[57] ABSTRACT

The disclosure relates to a selective printing apparatus adapted to be used in a hand held labeler. The apparatus includes selectively settable printing members driven by wheels coupled by gearing with read wheels for indicating the selected data to be printed. The read and print wheels are driven by a manually movable, shiftable and rotatable selector shaft. The print wheels are detented and the selector shaft is detented within holes in the print wheels. An indicator slidably mounted by a stationary frame is coupled to the selector shaft through a lost-motion connection to enable the print head to move between printing and non-printing positions.

12 Claims, 11 Drawing Figures

SELECTIVE PRINTING APPARATUS

CROSS-REFERENCE TO RELATED APPLICATION

This is a division of application Ser. No. 095,854 filed Nov. 19, 1979 pending.

BACKGROUND OF THE INVENTION

1. Field of the Invention

This invention relates to the art of selective printing apparatus.

2. Brief Description of the Prior Art

Various prior art U.S. Pat. Nos. 3,330,207 to De Man dated July 11, 1967; 3,886,862 to Hamisch, Jr. dated June 3, 1975; 3,908,543 to Wirth dated Sept. 30, 1975; 3,968,745 to Hamisch, Jr. dated July 13, 1976; 3,972,281 to Sams dated Aug. 3, 1976; and 4,055,118 to Yo Sato dated Oct. 25, 1977; and West German Offenlegungsschrift No. 2,350,537 are made of record.

SUMMARY OF THE INVENTION

The invention includes an improved, compact, low-cost print head. The print head is simple to construct, requiring relatively few parts, and yet the invention accomplishes effective detenting of a selector shaft of the selector mechanism in spite of a gear drive between the selector shaft and wheels which the selector shaft drives. According to a specific embodiment of the invention, the selector mechanism cooperates with a series of wheels. In the illustrated embodiment, each wheel has a printing member wrapped about is periphery, and each printing member has a series of different printing elements. The printing members are thus considered to be coupled to the respective wheels, but as far as the selector mechanism is concerned, each wheel could be coupled to a printing member by having the wheels and printing members being one-piece, e.g., a one-piece type wheel as in U.S. Pat. No. 3,908,543, or each wheel could be coupled to a printing member in the form of a printing band which is trained about the wheel and a fixed or movable support as in U.S. Pat. Nos. 3,886,862 and 3,968,745 and West German Offenlegungsschrift No. 23 50 537. In the illustrated embodiment, the selector shaft, which is both shiftable and rotatable, is engageable with any selected wheel. The detent mechanism for the selector shaft includes a slidably mounted yieldable detent member which can hold the selector shaft in any selected position, and there is a rotary connection between the detent member and the selector shaft. Thus, the selector shaft moves the detent member and yet the selector shaft is rotatable relative to the detent member. It is another feature of the invention to provide a slide which helps support the selector shaft. This slide performs the additional function of mounting the detent member. The selector shaft is preferably also supported at another location spaced from the slide. In addition to these features, the detent member is cooperable with the wheels with which the selector shaft engages. Detenting directly on the wheels enables wheels of any selected width or widths to be used without using a different detent member or selector shaft. The illustrated embodiment utilizes a gear drive between the selector shaft and the wheels.

The invention also includes an arrangement for visually indicating the indicia to be printed even though the print head is movably mounted with respect to an indicator. The print head moves between printing and non-printing positions and there is a connector between the print head and the indicator that allows such movement. According to an illustrative embodiment, there is a lost-motion connection between the selector shaft and the indicator. The illustrated connection is made by telescoping members. The indicator is shiftable in a stationary frame while the selector is both shiftable and rotatable.

In accordance with another feature of the invention, there is provided both an improved print wheel and an improved read wheel for a print head. These wheels have the feature of a generally annular base and a printing member received about the base. The base is provided with separate sockets and the marginal ends of the band has lugs which complement the sockets. The one socket and its complementary lug are dissimilar from the other socket and the lug which is complementary with the other socket. In this way the band can be connected to the wheel only one way. The wheel has means for orienting each wheel with respect to another similar wheel.

The invention also includes method of making the print head of the invention.

DETAILED DESCRIPTION OF THE PREFERRED EMBODIMENT

Figures 1, 2, 10, 11:
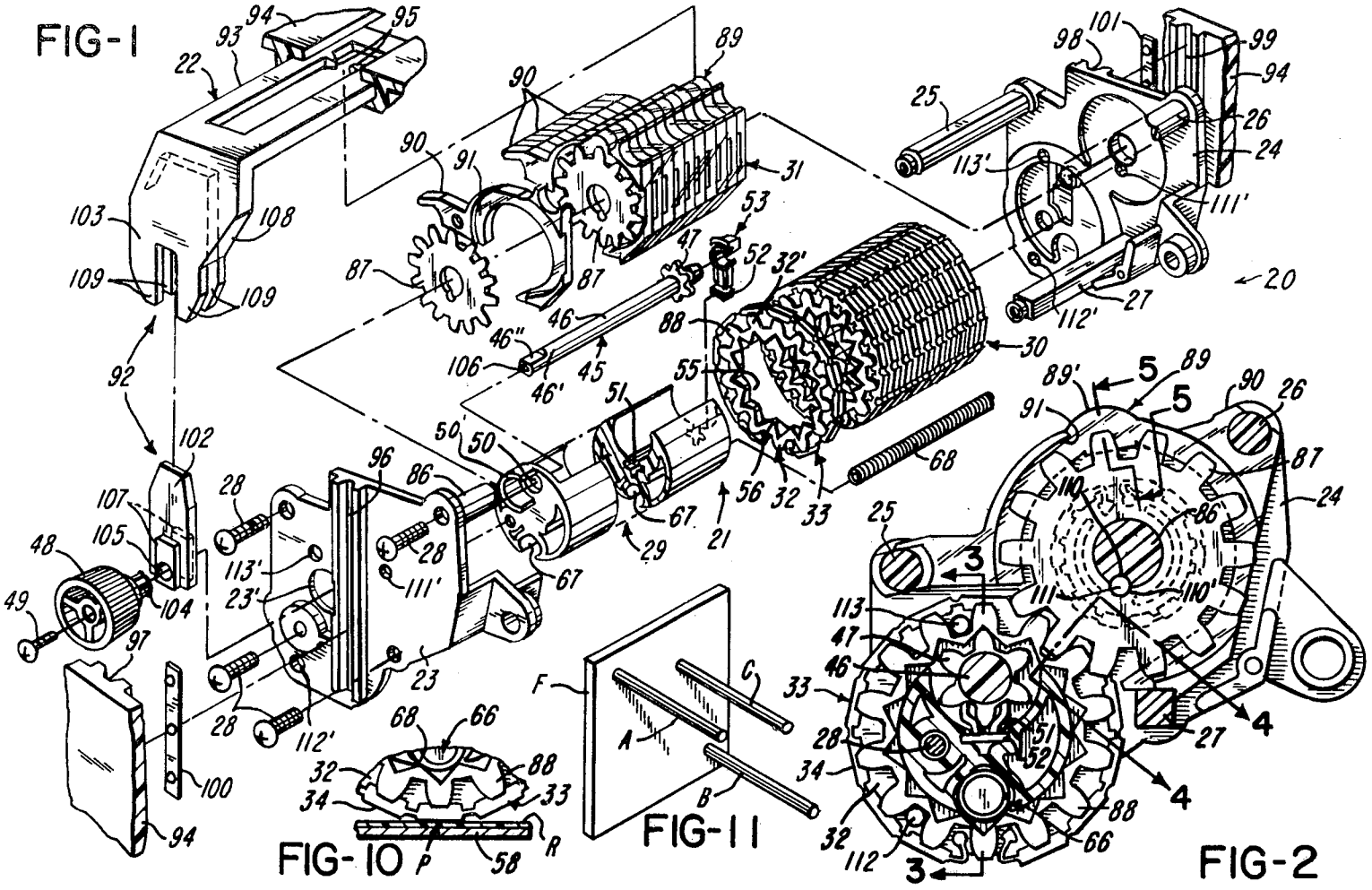
FIG. 1 is a partly exploded perspective view of a print head assembly in accordance with the invention.
FIG. 2 is a sectional view of the assembled print head of the print head assembly.
FIG. 10, which appears on sheet 1, shows the print wheel with one of the printing elements in a printing position adjacent the platen.
FIG. 11 is a perspective view of a fixture.

Referring initially to FIG. 1, there is shown a print head assembly generally indicated at 20 which includes a print head 21 and an indicator mechanism generally indicated at 22. The print head 21 is shown to include a pair of side plates 23 and 24 connected by posts 25, 26 and 27. Threaded fasteners 28 are received by the respective posts 25, 26 and 27 and one of the fasteners 28 is threadably received by a support generally indicated at 29. The posts 25, 26 and 27 and the support 29 are thus securely connected to the side plates 23 and 24 by the fasteners 28. The print head 21 includes a printing section 30 and a reading section 31. The printing section includes a series of wheels 32 rotatably mounted on the support 29 as best shown in FIG. 2. In the illustrated embodiment, each wheel 32 includes a base 32' (FIG. 7) about the periphery of which a printing member 33 is wrapped. The printing band 33 is shown to have a series of different printing elements 34 so that, for example, characters 0 to 9 and one or more symbols can be printed. The base 32' has a pair of narrow gaps 35 and 36. The gap 35 opens to the periphery of the base 32' and to a socket 37 and the gap 36 opens to the periphery of the base 32' and to a socket 38. Marginal end portions 39 and 40 of the printing member 33 are received in the respective gaps 35 and 36, and lugs 41 and 42 are received in respective sockets 37 and 38. The entries to the sockets 37 and 38 are beveled as shown at 43 and 44 for ease of the insertion of the lugs 41 and 42. The lugs 41 and 42 are considerably wider than the respective gaps 35 and 36 so that the lugs 41 and 42 are captive in the sockets 37 and 38. The printing members 33 are under slight tension so that they are held securely on their respective bases 32'.

Figure 3:
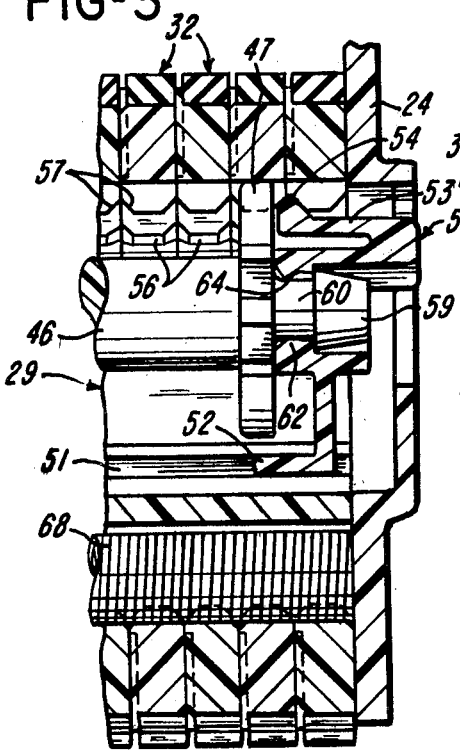
FIG. 3 is a sectional view taken generally along line 3—3 of FIG. 2.
Figure 4:
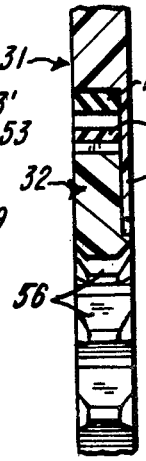
FIG. 4 is a sectional view taken generally along line 4—4 of FIG. 2.
Figure 5:
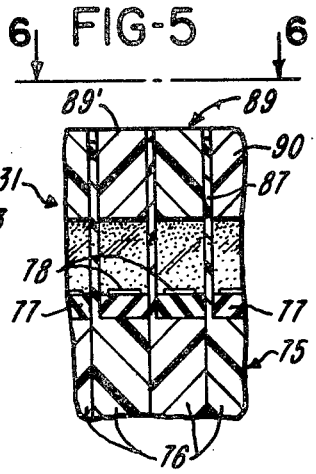
FIG. 5 is a sectional view taken generally along line 5—5 of FIG. 2.
Figure 6:
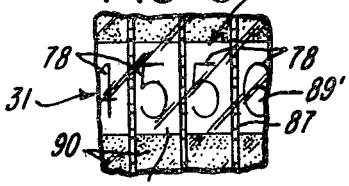
FIG. 6 is a top plan view taken along line 6—6 of FIG. 5.
Figure 9:
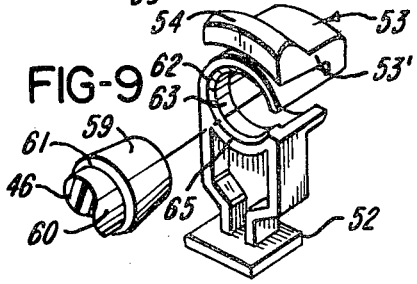
FIG. 9 is a perspective view showing a fragmentary portion of a selector shaft and an associated slide and yieldable detent member.

The wheels 32 are selectively settable. The selection is accomplished by a selector or selector mechanism generally indicated at 45 (FIG. 1) which includes a selector shaft 46 which carries a gear 47 and a manually engageable knob 48 suitably secured thereto as by a threaded fastener 49. The support 29 has an opening or aperture 50 which provides a surface for rotatably supporting the selector shaft 46. The support 29 includes a guideway or slideway 51 which is shown to extend in the lengthwise direction parallel to the axis of the wheels 32. The axis of the selector shaft 46 is also parallel to the axis of the wheels 32. The slideway 51 is shown to slidably mount a slide 52. The slide 52 mounts a yieldable detent member 53. The detent member 53 has a yieldable arm 53' (FIGS. 3 and 9) and a detent tooth 54. A generally central hole 55 in each wheel 32 is defined by an internal gear 56. The internal gear 56 has beveled side edges 57 into which the tooth 54 of the detent member 53 can move. The tooth 54 is shown in FIG. 3 to be detented between adjacent wheels 32 and the gear 47 is shown to be in mesh with a gear 56 of one of the wheels 32. By rotating the selector shaft 46, the wheel gear 56 with which the gear 47 is engaged is driven to bring a different printing element 34 to the printing position P adjacent a platen 58 to print on an intervening record R. The selector shaft 46 can be shifted by either pushing or pulling on the knob 48 to bring the gear 47 into meshing engagement with any one of the other wheel gears 56. The detent member 53 and the slide 52 are connected to the selector shaft 46 as best shown with reference to FIGS. 3 and 9. The selector shaft 46 has an outwardly converging head 59 which merges with a reduced portion 60. The reduced portion 60 is disposed between the head 59 and the gear 47 as shown in FIG. 3. The end of the head 59 adjacent the reduced portion 60 provides a shoulder 61. A socket 62 which is connected to the slide 52 and the detent member 53 provides a rotary connection with the selector shaft 46. The socket 62 has an inwardly extending projection with opposed shoulders 64 and 65. The shoulder 64 abuts the shoulder 61 and the shoulder 65 abuts the side of the gear 47. Thus, the socket 62 is captive between the shoulder 61 and the gear 47 so that the slide 52 and the detent member 53 move together with the selector shaft 46 whenever the selector shaft 46 is shifted. Moreover, the projection 62 is generally annular as is the outer surface of the reduced portion 60 and thus the selector shaft 46 can rotate relative to the slide 52 and to the detent member 53. The socket 62 is shown to be split to enable insertion of the head 59 to the position shown in FIG. 3.

Although the selector mechanism 45 is shown to be used in conjunction with wheels that print, this selector mechanism 45 could also be used in conjunction with wheels that drive print bands about a support as in U.S. Pat. No. 3,968,745 or in conjunction with wheels that drive print wheels, for example.

Figure 7:
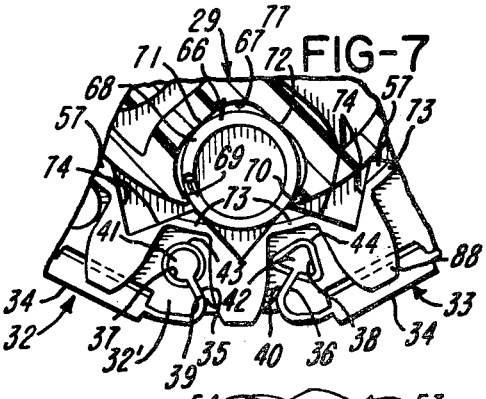
FIG. 7 is a fragmentary sectional view of a print wheel.

The wheels 32 are shown to be detented in any selected position by a detent mechanism generally indicated at 66. The support 29 also includes a recess 67 which extends in the lengthwise direction parallel to the axis of the wheels 32. The recess 67 is shown to open to the outer periphery of the support 29. The recess 67 receives a detent member in the form of a helical spring 68. The spring 68 is preferably of one-piece construction so that it contacts and is common to all the wheels 32. The recess 67 is contoured so that the spring 68 is contacted and supported in the recess at four locations 69, 70, 71 and 72 and extends beyond the periphery of the support 29. The spring 68 is essentially non-deformable, whereas the wheels 32 deform resiliently when indexed. The turns of the spring 68 are tightly wound as best shown in FIG. 3 and preferably the spring 68 is composed of metal, specifically small diameter wire. The wire diameter is less than the thickness of a wheel 32. The bases 32' of the wheels 32 are composed of plastics material which is resiliently deformable when a wheel 32 is indexed. The internal gear 56 has teeth 73 defined by pairs of converging surfaces 74. In a detented position as shown in FIGS. 7 and 10 for example, the spring 68 is shown to be in contact with both converging surfaces 74 of a pair. Each pair of converging recesses 74 provides a recess. When a wheel 32 is advanced, one pair of converging surfaces 74 leaves contact with the spring 68 and an adjacent pair of converging surfaces 74 are cammed into cooperation with the spring 68 by the spring 68 as the wheel returns to its original shape.

Figure 8:
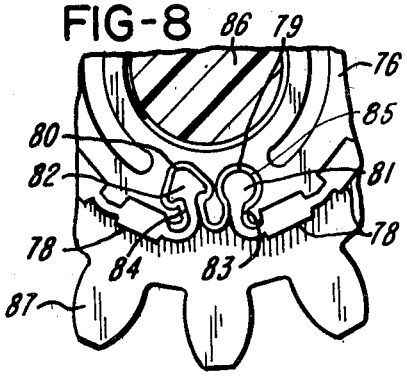
FIG. 8 is a fragmentary sectional view of a read wheel.

The reading wheel section 31 is shown to include a series of read wheels 75. The read wheels 75 have generally annular bases 76 about which bands 77 are wrapped. The bands 77 have human readable indicia 78 corresponding to the printing elements 34 on the wheels 32. The base 76 (FIG. 8) of each wheel 75 has a pair of sockets 79 and 80 for receiving respective lugs 81 and 82. A narrow gap 83 opens into the socket 79 and to the outer periphery of the base 76 and a narrow gap 84 opens into the socket 80 and into the outer periphery of the base 76. The gaps 83 and 84 are narrower than respective lugs 81 and 82 so that the lugs 81 and 82 are held captive in respective sockets 79 and 80. There is a continuous bevel 85 in the side of the base 76 adjacent the sockets 81 and 82 and the gaps 83 and 84 to facilitate insertion of the lugs 81 and 82. The bases 76 are shown to be rotatably mounted on a post or shaft 86. A gear 87 is connected to each wheel 75 and is preferably molded integrally with the base 76. Each gear 87 meshes with a gear 88 which is connected to a respective wheel 32. The gear 88 is preferably molded integrally with respective base 32'. When the selector shaft 46 is rotated, the gear 88 associated with the selected wheel 32 drives a meshing gear 87 of a respective read wheel 75. The user can observe which printing elements 34 are at the printing position P by looking through transparent portions or windows 89 of respective members 90. Each member 90 has a plurality of functions. Each member 90 is preferably molded from plastics material. The surface of each member 90 is matte or non-transparent except for the window 89, the outer surface of which is arched to provide a lens 89'. The lenses 89' provide some magnification of indicia 78 on the read wheels 75.

The members 90 have recesses 91 which have a depth substantially equal to the width or thickness of the gear 87 which they guide. The members 90 are arranged in a stack so that the gears 87 are trapped between adjacent members 90. Each member 90 has the same width (except for clearance) as an associated wheel 32 and it is apparent that the members 90 guide the gears 87 for rotation in respective paths in alignment with respective meshing gears 88. The members 90 also serve as shields to prevent damage to the gears 87 in the event the print head or the labeler or other printing apparatus of which it forms a part should be dropped or otherwise abused.

While the user can visually observe the printing elements which are at the printing position by peering through the window 89, the user is informed as to the particular wheel 32 with which the selector shaft 46 is coupled by means of the indicator mechanism 22. The indicator mechanism 22 is connected to the print head 21 by a connection generally indicated at 92 which enables the print head 21 to move into and out of printing cooperation with the platen 58, while an indicator 93 is only slidable relative to a fixed frame 94. The indicator 93 is slidable in a track parallel to the direction of shifting movement of the selector shaft 46. The indicator 93 includes a pair of opposed pointers 95 which are aligned with the gear 47 of the selector 45 and with the respective read wheel 75 at the window 89. The print head 21 is guided for back and forth movement by two pairs of opposed ball tracks 96 and 97, and 98 and 99. The ball tracks 97 and 99 are considered to be part of the frame 94. Ball bearing strips 100 and 101 are disposed between respective ball tracks 96 and 97, and 98 and 99. The connection 92 is more particularly a lost-motion connection. Specifically, the connection between the print head 21 and the indicator 93 includes a pair of telescoping members 102 and 103. The member 102 is connected to the selector shaft 46. A tubular projection 104 on the knob 48 extends into a hole 105 in the member 102. The screw 49 extends through the knob 48 and into its tubular projection 104 and is threadably received by a hole 106 in the selector shaft 46. The member 102 is free to pivot on the projection 104. The opposite sides of the member 102 are provided with guide members or lugs 107. The indicator 93 has a depending, essentially hollow member 108 having four spaced apart projections 109. The member 102 is telescopically received in the member 108. Each guide member 107 slides in slidable relationship between two respective pairs of the projections 109. The guide members 107 are in constant guided relationship with the projections 109 irrespective of whether the print head 21 is in the printing position or is in the non-printing position in which the print head 21 is spaced from the platen 58. Notwithstanding the fact that the print head 21 moves between the printing and non-printing positions, the indicator mechanism 22 remains coupled with the print head 21 and in particular remains coupled with the selector shaft 46.

The shaft 86 has an axially extending groove 110 which is shown to semi-circular, and each wheel base 76 has a groove or opening 110' which is shown to be semi-circular. When the grooves 110 and 110' are aligned they form a locating hole or opening 111. Each wheel has holes or openings 112 and 113 angularly spaced apart by other than 180°. In assembling the print head 21, the support 29 is connected to the side plate 23 by a screw 28. When the support 29 is connected to the side plate 23, arcuate projection 50', which partially surrounds the axis of the hole 50, fits snugly into a hole 23' in the side plate 23. Thereupon, side plate 23 is placed in a fixture F with pins A, B and C sticking through respective holes or openings 111', 112' and 113' in the side plate 23. The side plate 24 also has corresponding aligned holes 111', 112' and 113'. A wheel 32 and a corresponding read wheel 75 are assembled in pairs onto respective supports 29 and 86. The wheels 32 and 75 can only be assembled one way because of the pins A, B and C. Specifically the pin A extends through the holes 111' (in side plate 23) and 111, the pin B extends through holes 112' and 112, and pin C extends through holes 113' and 113. As indicated above, the printing members 33 can only be assembled onto the respective wheels 32 one way, and the bands 77 can only be assembed onto the respective bases 76 one way. Each wheel 76 could be provided with an additional aligning hole disposed at an angular position of other than 180° from the notch 110' but the same result can be obtained by observing that each gear 88 must be spaced from the adjacent gear or gears. Thus, if two gears 88 are in face-to-face contact, then one of the contacting gears 88 is turned the wrong way. When all the wheels 32 and 75 are properly aligned, the readable indicia 34 are all in a straight row showing blanks and the blank positions of labels 32 are at the printing position as shown in FIG. 2 for example. When all the wheels 32 and 75 are assembled, the selector shaft 46, coupled to the slide 52 and to the detent member 53, is inserted into the space within the wheels 32 with its end portion 46' extending a short distance through hole 23'. When thus positioning the selector shaft 46, the slide 52 is inserted through the end of the slideway 51. In this position of the selector shaft 46, the member 102 can be slid onto the projection 104 and the knob 48 can be slipped over the end portion 46' so that flat 46'' complements a corresponding flat (not shown) on the knob 48. The knob 48 is thus non-rotatably connected to the shaft 46 and the screw 49 keeps the knob 48 from slipping off the shaft 46. The screw 49 also spreads the projection 104 which is split to prevent the connector 102 from shifting axially on the projection. Thereafter the side plate 24 is connected to the side plate 23 by the rest of the screws 28.

With the exception of the metal screws 28 and 49, the metal ball bearing strips 100 and 101, the metal spring 68, and the bands 33 and 77 which are composed of elastomeric material, the entire assembly 20 is composed of moldable plastics material. The one-piece element which comprises the slide 52, the detent member 53 and the socket 62 is constructed of a material that is sufficiently flexible and resilient to enable the arm 53' to flex as the selector shaft 46 is shifted axially and to enable the socket 62 to open to receive the head 59 during assembly. Also the entire shaft 46 and the gear 47 are molded as one piece.

While it is preferred to detent the selector 46 and the wheels 32 in the space within wheels 32, in another embodiment (not shown) the detenting of both the selector 46 and read wheels 75 is accomplished in the space within the read wheels 75.

Other embodiments and modifications of this invention will suggest themselves to those skilled in the art, and all such of these as come within the spirit of this invention are included within its scope as best defined by the appended claims.

I claim:

1. In a print head: a wheel having a generally annular base, a pair of separate first and second sockets in the base disposed inwardly from the outer periphery of the base, a narrow first gap opening into the first socket and extending to the outer periphery of the base, a narrow second gap opening into the second socket and extending to the outer periphery of the base, elongate band having first and second lugs at its opposite first and second end portions, the band being received about the base and having indicia at its outer surface, the first lug being wider than the first gap, the second lug being wider than the second gap, the first end portion being received in the first gap and the first lug being received in the first socket, and the second end portion being received in the second gap and the second lug being received in the second socket, wherein the first socket and the first lug are dissimilar from the second socket and the second lug.

2. A wheel as defined in claim 1, wherein the band has human readable characters at its outer periphery.

3. A wheel as defined in claim 1, wherein the band has printing characters at its outer periphery.

4. A wheel as defined in either of claims 2 or 3, wherein the wheel includes means for orienting the wheel with respect to another similar wheel.

5. A wheel as defined in claim 1, wherein the first socket and the first lug are generally circular and the second socket and the second lug are generally non-circular.

6. In a print head: a wheel having a generally annular base, a pair of separate first and second sockets in the base disposed inwardly from the outer periphery of the base, a narrow first gap opening into the first socket and extending to the outer periphery of the base, a narrow second gap opening into the second socket and extending to the outer periphery of the base, an elongate band having first and second lugs at its opposite first and second end portions, the band being received about the base and having indicia at its outer surface, the first lug being wider than the first gap, the second lug being wider than the second gap, the first end portion being received in the first gap and the first lug being received in the first socket, the second end portion being received in the second gap and the second lug being received in the second socket, and means for orienting the band only one way with respect to the base.

7. A wheel as defined in claim 6, wherein the wheel includes means for orienting the wheel with respect to another similar wheel.

8. For a printer: a stationary frame, a print head having a plurality of settable printing members for printing selected data and a shiftable and rotatable selector shaft for moving any selected printing member, a shiftable indicator mounted on the frame for indicating the selected data, means mounting the print head for movement between printing and non-printing positions and away from and toward the indicator, and means coupling the print head and the indicator to provide for setting of the printing members even though the print head is movable between printing and non-printing positions.

9. The invention as defined in claim 8, wherein the print head includes a plurality of wheels movably coupled to the respective printing members, the selector shaft being engageable with any selected wheel, the coupling including a lost-motion connection between the selector shaft and the indicator.

10. The invention as defined in claim 8, wherein the print head includes a plurality of wheels movably coupled to the respective printing members, the selector shaft being engageable with any selected wheel, wherein the coupling means includes cooperating telescoping members.

11. The invention as defined in claim 8, wherein the coupling means includes cooperating telescoping member.

12. For a printer: a stationary frame, a print head, the print head having settable printing members for printing selected data, a shiftable indicator mounted on the stationary frame for indicating the selected data, means mounting the print head for movement between printing and non-printing positions and away from and toward the indicator, and a lost-motion coupling between the print head and the indicator for enabling the print head to move between the printing and non-printing positions relative to the indicator while maintaining the indicator in indicating relationship with respect to the print head.

* * * * *